US008142234B2

(12) United States Patent
Kaneshiro

(10) Patent No.: US 8,142,234 B2
(45) Date of Patent: Mar. 27, 2012

(54) TERMINAL BLOCK AND METHOD OF ASSEMBLING IT

(75) Inventor: Daiki Kaneshiro, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/941,421

(22) Filed: Nov. 8, 2010

(65) Prior Publication Data

US 2011/0117792 A1 May 19, 2011

(30) Foreign Application Priority Data

Nov. 13, 2009 (JP) ..... 2009-260059

(51) Int. Cl.
*H01R 9/22* (2006.01)

(52) U.S. Cl. ..... 439/709

(58) Field of Classification Search ..... 439/709, 439/721, 723
See application file for complete search history.

(56) References Cited

U.S. PATENT DOCUMENTS 6,612,878 B2 * 9/2003 Lias et al. ..... 439/709
6,819,081 B2 11/2004 Izawa et al.
7,094,098 B2 * 8/2006 Miyazaki ..... 439/559
7,811,116 B2 * 10/2010 Sakakura et al. ..... 439/364
7,955,141 B2 * 6/2011 Jang et al. ..... 439/709
2003/0148667 A1 * 8/2003 Lias et al. ..... 439/709
2005/0090154 A1 * 4/2005 Ikeda et al. ..... 439/709
2011/0117792 A1 * 5/2011 Kaneshiro ..... 439/709
2011/0130049 A1 * 6/2011 Kaneshiro ..... 439/709

* cited by examiner

*Primary Examiner* — Ross Gushi

(74) *Attorney, Agent, or Firm* — Gerald E. Hespos; Michael J. Porco

(57) ABSTRACT

A terminal block (10) has a housing (20), a busbar mounting portion (23) formed in the housing (20), nut accommodating recesses (27) formed in the busbar mounting portion (23) for holding nuts (N) mounted in a first direction (D1), a busbar (30) mounted into the busbar mounting portion (23) in a second direction (D2) intersecting the first direction (D1) and holding the nuts (N) in the nut accommodating recesses (27), busbar pressers (23B) provided in the busbar mounting portion (23) for restricting a movement of the busbar (30) in the busbar mounting portion (23) in a direction opposite to the first direction (D1), and locks (28) provided in the busbar mounting portion (23) for restricting movement of the busbar (30) in the busbar mounting portion (23) in a direction opposite to the second direction (D2).

12 Claims, 8 Drawing Sheets

TERMINAL BLOCK AND METHOD OF ASSEMBLING IT

BACKGROUND OF THE INVENTION

1. Field of the Invention

The invention relates to a terminal block and to a method of assembling or producing it.

2. Description of the Related Art

A terminal block conventional terminal block includes a housing with nut accommodating portions for accommodating nuts and a nut retainer to retain the nuts in the nut accommodating portions. The nut retainer is an extra part that adds to the cost of the terminal block. Accordingly there is a desire to provide a terminal block without a nut retainer.

U.S. Pat. No. 6,819,081 discloses a terminal block that eliminates a nut retainer by fixing the nuts to the lower surface of a busbar. However, a process of fixing the nuts to the busbar by welding or by an adhesive is necessary and the additional process steps lead to a cost increase.

The present invention was developed in view of the above situation and an object thereof is to dispense with a nut retainer for a terminal block without increasing cost.

SUMMARY OF THE INVENTION

The invention relates to a terminal block with a housing. At least one nut accommodating recess is formed in the housing for holding at least one nut mounted in a first direction while preventing the nut from turning. The terminal block further includes at least one busbar mounting portion that communicates with the nut accommodating recess. The busbar mounting portions is at a side closer to an outer surface of the terminal block housing than the nut accommodating recess. At least one busbar is mounted into the busbar mounting portion in a second direction that intersects the first direction. The busbar is configured to hold the nut in the nut accommodating recess. At least one first restricting portion is provided at the busbar mounting portion for restricting a movement of the busbar in the busbar mounting portion in a direction substantially opposite to the first direction. At least one second restricting portion provided at the busbar mounting portion for restricting a movement of the busbar in the busbar mounting portion in a direction substantially opposite to the second direction.

Accordingly, mounting the busbar into the busbar mounting portion holds the nut in the nut accommodating recess. The first restricting portion restricts movement of the busbar in the direction substantially opposite to the first direction and the second restricting portion restricts movement of the busbar in the direction substantially opposite to the second direction. Thus, the busbar is held securely in the busbar mounting portion and the busbar holds the nut reliably in the nut accommodating recess. Therefore, a nut retainer is eliminated without a cost increase.

At least one terminal may be bolt-fastened to the busbar, and the busbar may be bent to circumvent the terminal and/or a wire connected to the terminal.

The first restricting portion may extend in a direction intersecting both the first direction and the second direction. Accordingly, the first restricting portion can be formed to cross busbars in embodiments having a plurality of busbars arranged side by side.

The first restricting portion may be formed to cover the busbar over at least part of the periphery by connecting a pair of side walls substantially arranged in a longitudinal direction of the busbar along lateral edges of the busbar. Surrounding the periphery of the busbar increases the rigidity of the first restricting portion.

The second restricting portion may substantially face the first restricting portion in the busbar mounting portion. Thus, the first and second restricting portions can be arranged in a concentrated manner and a bolt fastening portion can be arranged more easily in another part.

These and other objects, features and advantages of the invention will become more apparent upon reading of the following detailed description of preferred embodiments and accompanying drawings.

DETAILED DESCRIPTION OF THE PREFERRED EMBODIMENTS

Figure 1:
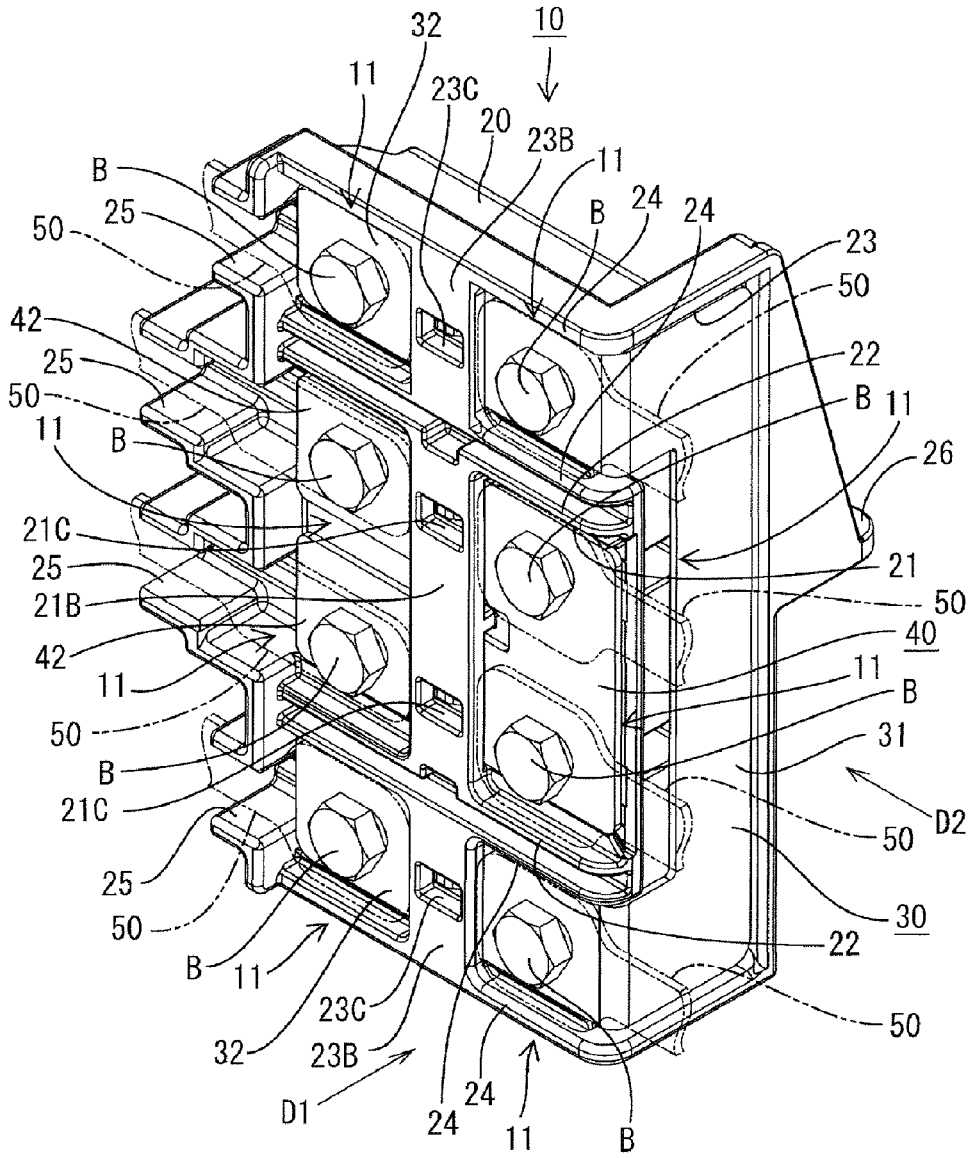
FIG. 1 is a perspective view of a terminal block according to one embodiment.

A terminal block in accordance with the invention is identified generally by the numeral 10 in FIGS. 1 to 8. The terminal block 10 includes a housing 20 in the form of a substantially rectangular block, as shown in FIG. 1. Large and small busbars 30 and 40 are mounted on the terminal block housing 20. The reference herein to vertical and lateral directions are based on the FIG. 2 orientation.

Two lines of bolt fastening portions 11 are arranged substantially side by side in a lateral direction on the terminal block 10 and each line has four bolt fastening portions 11 arranged in a vertical direction. A bolt B is to be fastened to each bolt fastening portion 11 and a round terminal 50 is sandwiched and fastened between the head of the bolt B and the corresponding busbar 30 or 40.

Figure 2:
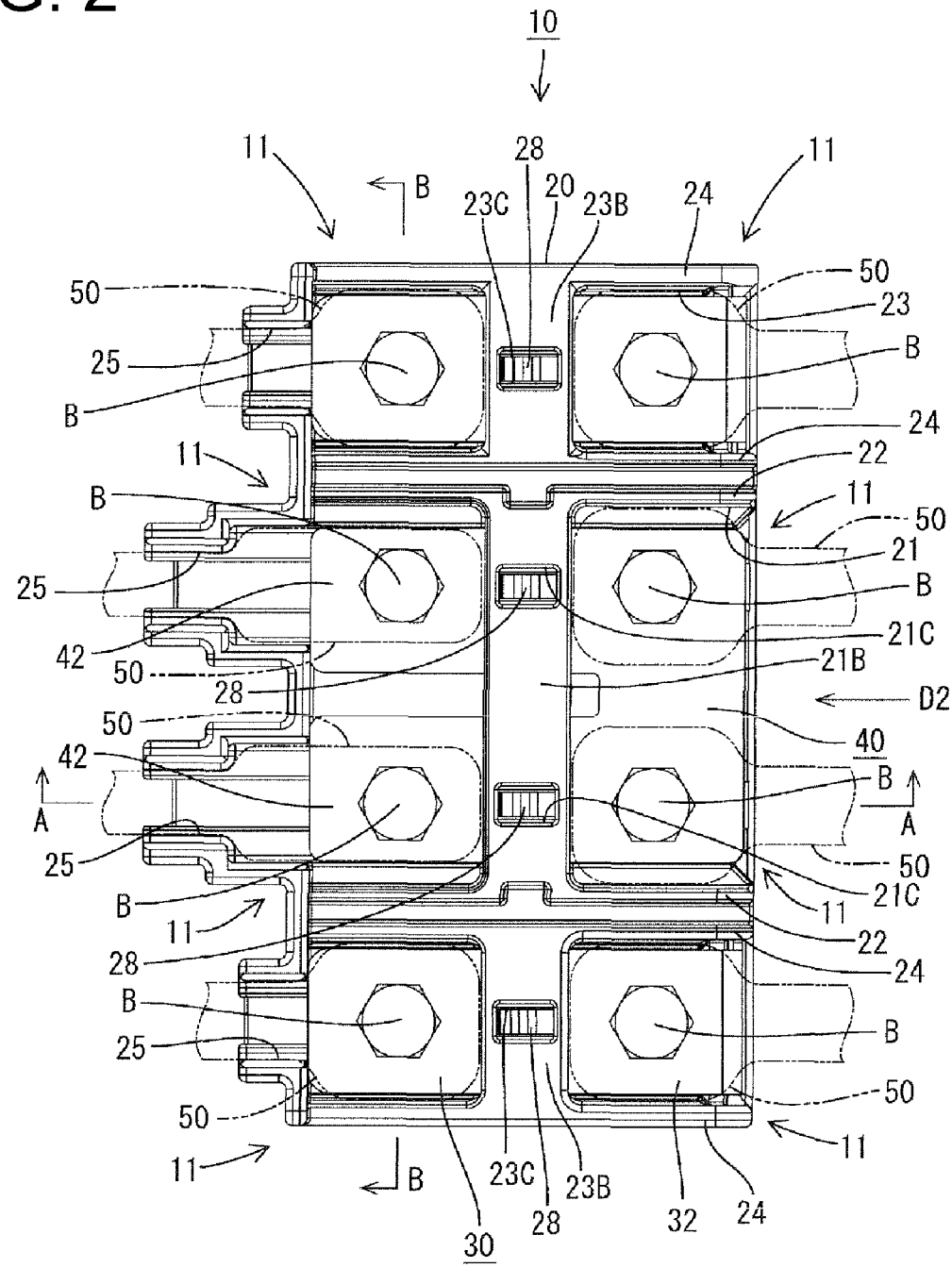
FIG. 2 is a front view of the terminal block.
Figure 4:
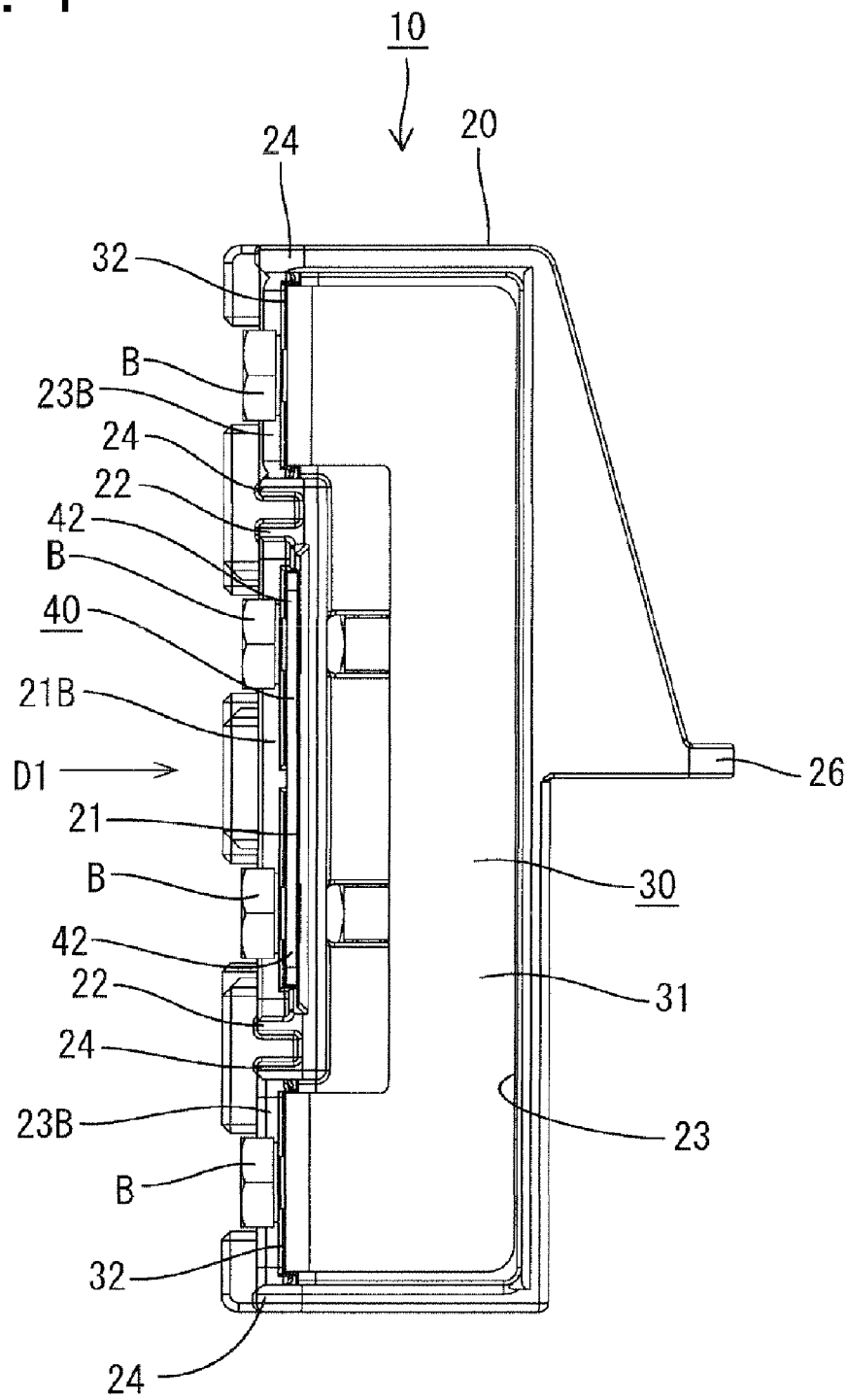
FIG. 4 is a right side view of the terminal block.
Figure 5:
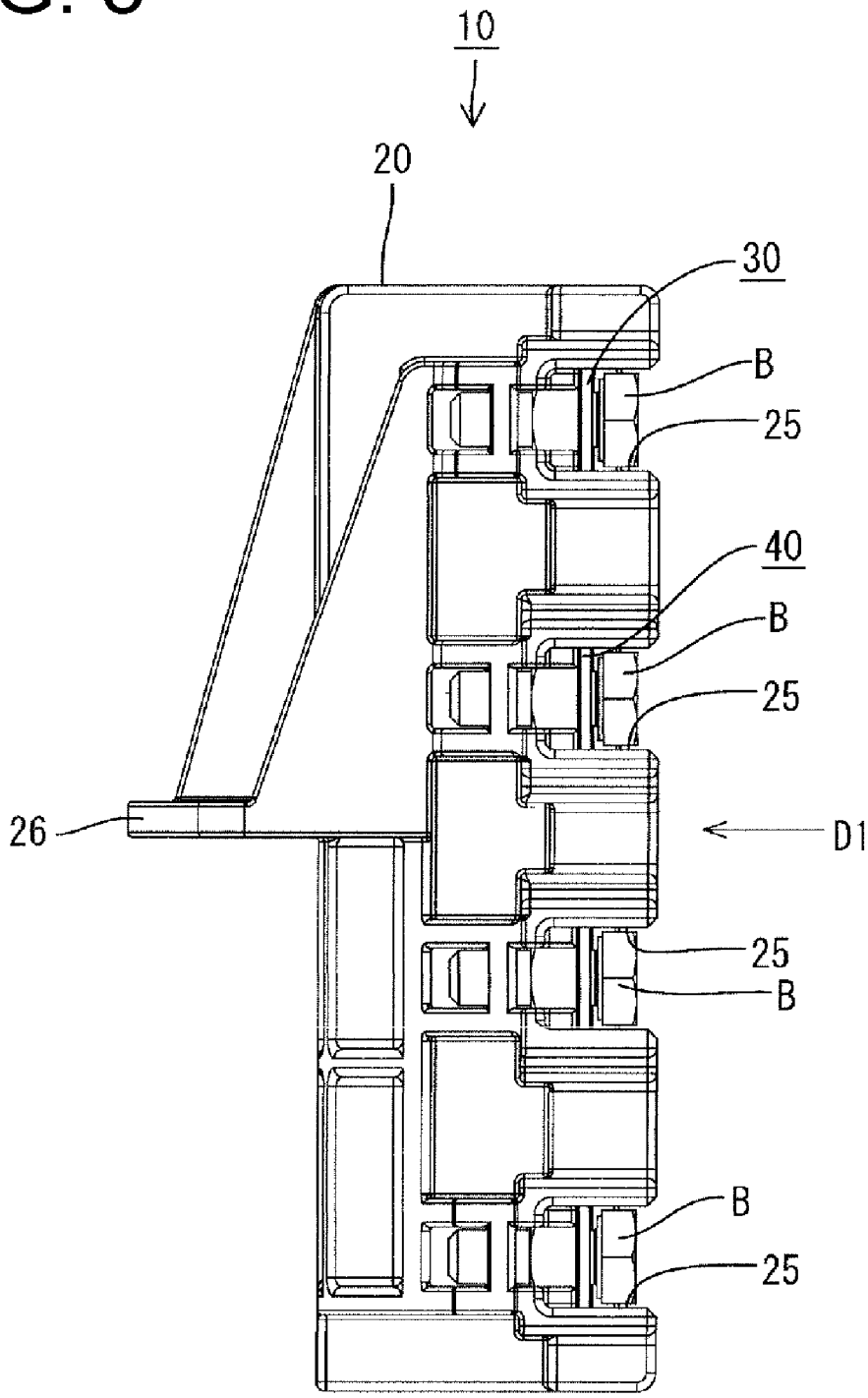
FIG. 5 is a left side view of the terminal block.

The small busbar 40 has a substantially U shape with an opening at the left side in the front view shown in FIG. 2. The large busbar 30 is punched or cut out into a substantially U shape with an opening at the left side similar to the small busbar 40. However, the large busbar 30 has a right part 31 bent substantially at a right angle toward the rear of the terminal block 10. More particularly, the right part 31 of the large busbar 30 is bent toward the rear side of the terminal block 10 to circumvent the round terminals 50 that are bolt-fastened to the small busbar 40, as shown in FIG. 1. As a result, two fastening parts 32 are formed on the upper and/or lower sides of the large busbar 30, excluding the right part 31. The fastening parts 32 are arranged substantially on the same plane as the small busbar 40, as shown in FIG. 4 or 5, and a lateral dimension of the large busbar 30 is substantially equal to the lateral dimension of the small busbar 40, as shown in FIG. 2.

The front surface of the housing 20 is recessed to form a small busbar mounting portion 21 for receiving the small busbar 40 is to be mounted. Two substantially rib-shaped partition walls 22 are formed on opposite upper and lower sides of the small busbar mounting portion 21. The partition walls 22 extend in the lateral direction along upper and lower edges of the small busbar 40. A distance between the partition walls 22 is substantially equal to a vertical dimension of the small busbar 40. Thus, the small busbar 40 can be mounted in the small busbar mounting portion 21 by inserting the small busbar 40 laterally from the right side to the left side of the terminal block 10 with the opposite upper and lower edges of the small busbar 40 sliding along the opposite partition walls 22. The direction from the right side toward the left side of the terminal block 10 is referred to as a second direction D2 in the following description.

An area of the terminal block housing 20 extending from the front surface to the right surface is recessed to form a large busbar mounting portion 23 for receiving the large busbar 30. Four rib-shaped guide walls 24 extend laterally on the front side of the terminal block 10 at peripheral edges of the large busbar mounting portion 23. A distance between the two guide walls 24 on the upper side is substantially equal to a vertical dimension of the fastening parts 32 of the large busbar 30, and a distance between the two guide walls 24 on the lower side also is substantially equal to the vertical dimension of the fastening parts 32 of the large busbar 30. Thus, the large busbar 30 can be mounted in the large busbar mounting portion 23 by inserting the large busbar 30 in the second direction D2 with opposite upper and lower edges of both fastening parts 32 of the large busbar 30 sliding along the respective guide walls 24.

Figure 6:
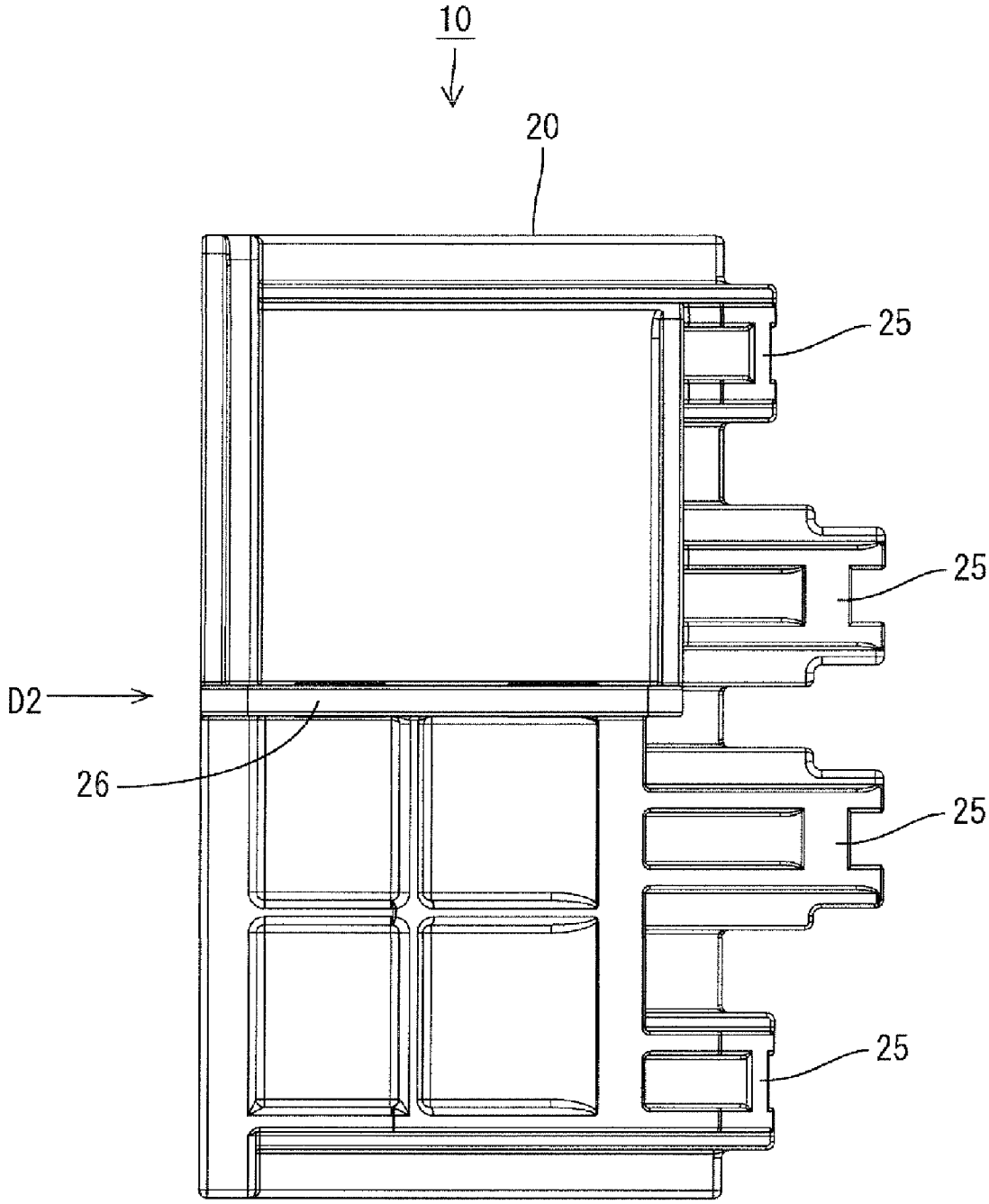
FIG. 6 is a rear view of the terminal block.

Four terminal identifying portions 25 project laterally from the left surface of the housing 20, as shown in FIG. 2 or 6. The terminal identifying portions 25 are arranged in the vertical direction and correspond to two types of round terminals 50 having different shapes. The two types of terminal identifying portions having different shapes. More particularly, the terminal identifying portions 25 on the upper and lower sides substantially correspond to short round terminals 50, and the terminal identifying portions 25 in the center position correspond to long round terminals 50. In this way, erroneous assembling of the long round terminals 50 and the short round terminals 50 is prevented.

Figure 3:
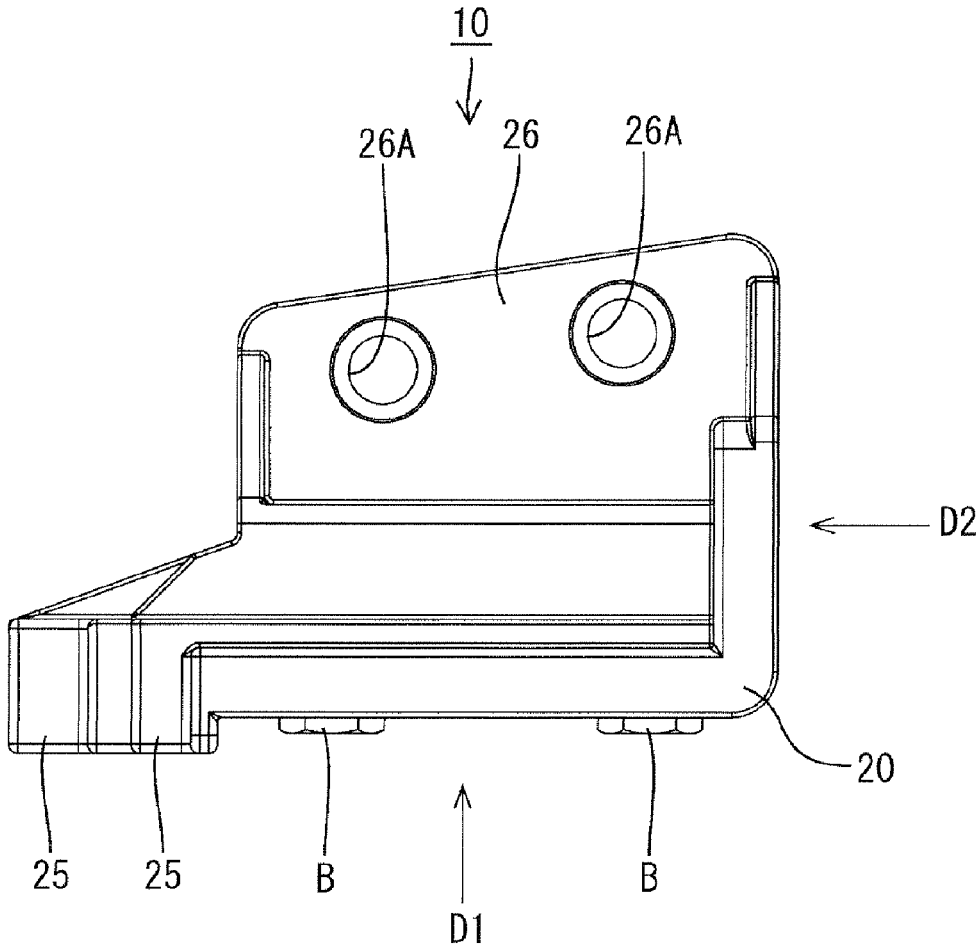
FIG. 3 is a plan view of the terminal block.

As shown in FIG. 3, a mounting portion 26 to be mounted on a device (not shown) projects from the rear surface of the housing 20. Two mounting holes 26A vertically penetrate through the mounting portion 26, and the terminal block 10 is fixed to the device by inserting one or more bolts (not shown) into the respective mounting holes 26A and fastening the bolts.

Figure 7:
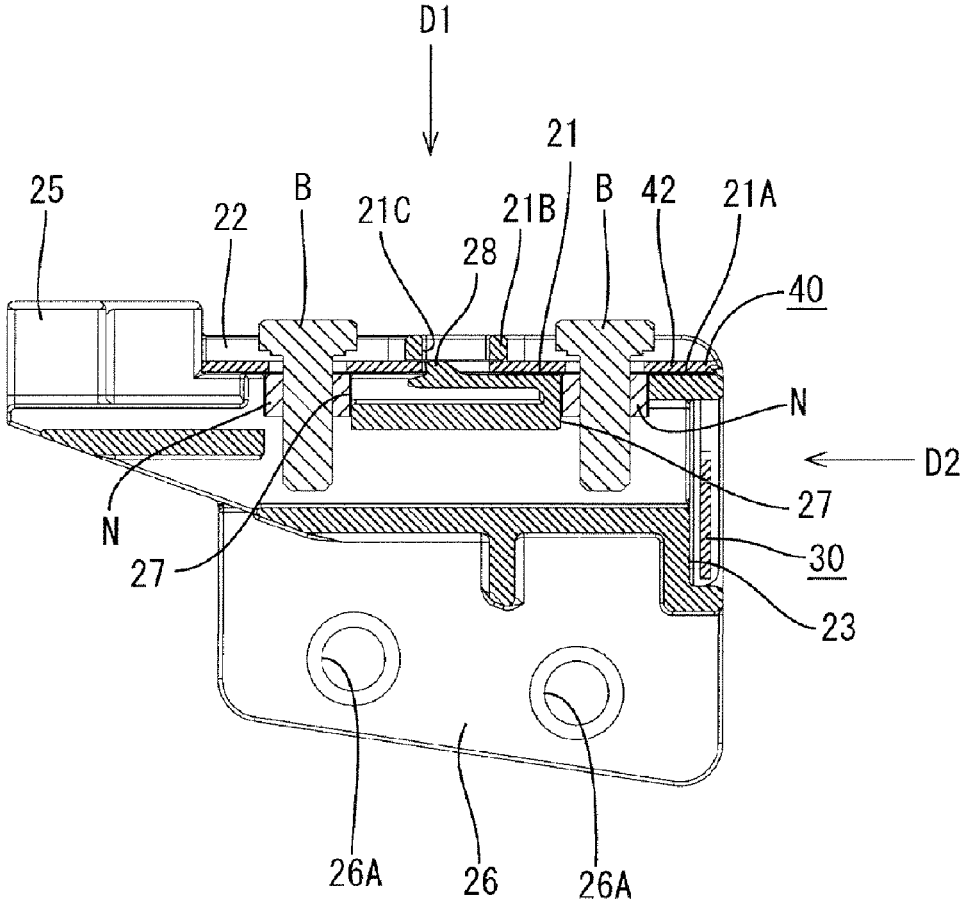
FIG. 7 is a section along A-A of FIG. 2.
Figure 8:
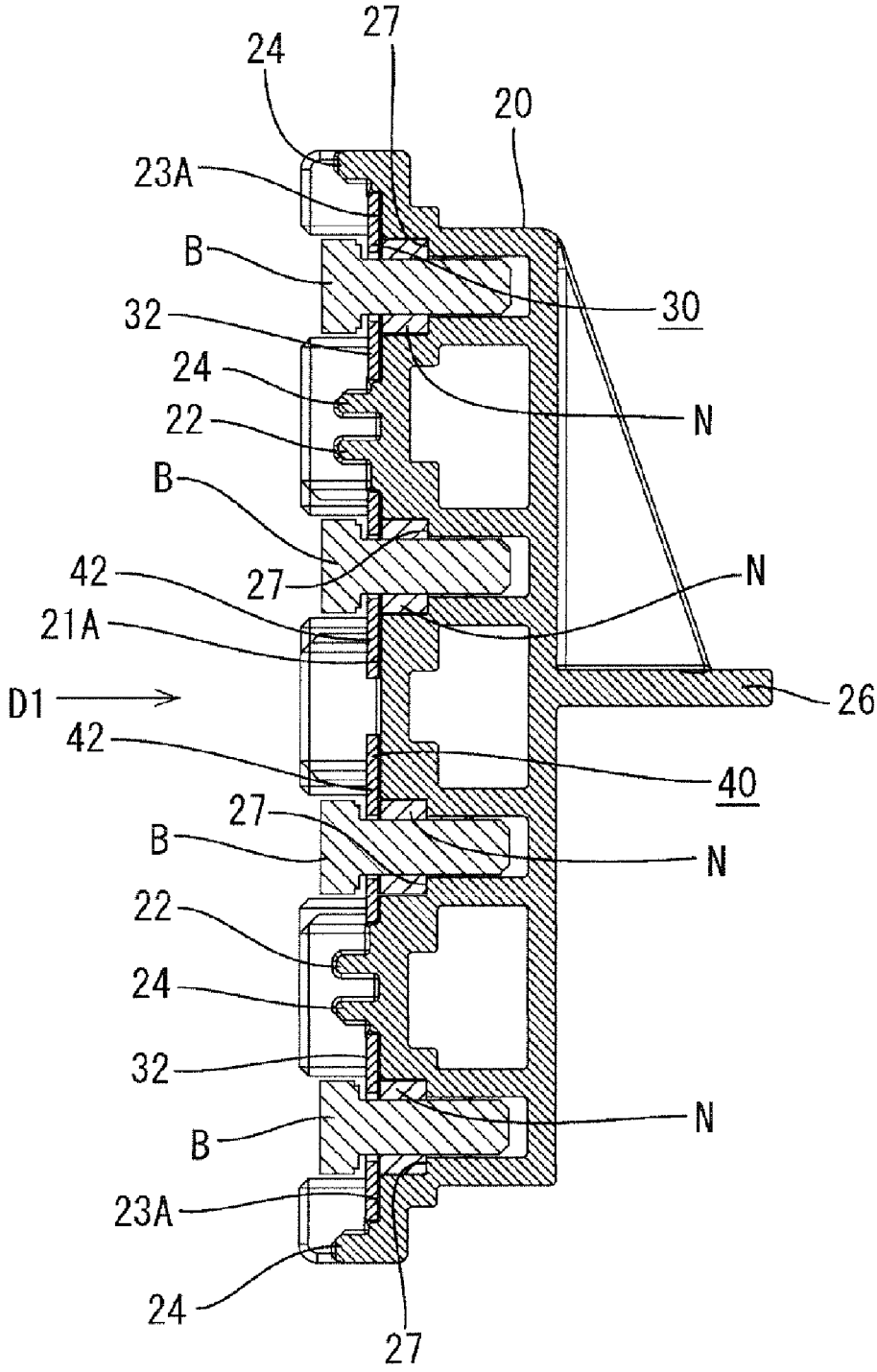
FIG. 8 is a section along B-B of FIG. 2.

A mounting surface 21A, 23A of each busbar mounting portion 21, 23, in which the busbar 30, 40 is to be mounted, is recessed to form nut accommodating recesses 27 for holding nuts N and preventing the nuts N from turning as shown in FIG. 7 or 8. Each nut accommodating recess 27 is a recess formed in the mounting surface 21A, 23A and includes a peripheral surface substantially in conformity with the outer peripheral surface of the nut N. Thus, when the nut N is mounted into the nut accommodating recess 27 in a direction from the front to the rear of the terminal block 10, at least part of the outer peripheral surface of the nut N and at least part of the peripheral surface of the nut accommodating recess 27 engage to prevent the nut N from turning. The direction from the front toward the rear of the terminal block 10 is called a first direction D1 herein.

The busbars 30, 40 are mounted in the corresponding busbar mounting portions 21, 23 in the second direction D2 after the respective nuts N are accommodated into the nut accommodating recesses 27 in the first direction D1. Thus, the busbars 30, 40 are arranged on mounting paths of the nuts N and hold the nuts N in the nut accommodating recesses 27.

Large busbar pressers 23B bridge between two adjacent guide walls 24 of the large busbar mounting portion 23 for preventing movement of the large busbar 30 in a direction opposite to the first direction D1. Thus, the large busbar pressers 23B correspond to the respective fastening parts 32. The large busbar pressers 23B, the guide walls 24 and the mounting surface 23A substantially surrounding the large busbar 30. Thus, rigidity of the large busbar presser 23B is increased and a movement of the large busbar 30 in a direction opposite to the first direction D1 is restricted reliably.

On the other hand, a small busbar presser 21B bridges between the opposite partition walls 22 of the small busbar mounting portion 21. The small busbar presser 21B, the partition walls 22 and the mounting surface 21A substantially surrounding the small busbar 40. Thus, rigidity of the small busbar presser 21B is increased to restrict movement of the small busbar 40 in the direction opposite to the first direction D1.

The large busbar pressers 23B are aligned substantially vertically and substantially orthogonal to both the first direction D1 and the second direction D2. Additionally, the large busbar pressers 23B are substantially in the lateral center of the housing 20. The small busbar presser 21B has the same width as the large busbar pressers 23B and is aligned substantially with the large busbar pressers 23B in the vertical direction. Thus, the respective busbar pressers 21B, 23B extend substantially across the fastening parts 32, 42 of the respective busbars 30, 40. This enables the structures of the respective busbar pressers 21B, 23B to be simplified so that the respective busbar pressers 21B, 23B can be formed easily. The large and small busbar pressers 23B and 21B are referred to herein as first restricting portions.

Two locks 28 are provided in laterally intermediate positions of the mounting surface 21A of the small busbar mounting portion 21, as shown in FIG. 7. The locks 28 are resiliently deformable in the first direction D1 and engage with locking holes 41 formed in the upper and lower fastening parts 42 of the small busbar 40. The engagement of the locking pieces 28 with the locking holes 41 restricts movement of the small busbar 40 in a direction opposite to the second direction D2.

Two locks 28 also are provided at the mounting surface 23A of the large busbar mounting portion 23 at positions to correspond to the upper and lower fastening parts 32. Further, two locking holes 33 penetrate through the fastening parts 32 of the large busbar 30 and are engaged by respective locks 28 to restrict a movement of the large busbar 30 in the direction opposite to the second direction D2. The locks 28 are referred to herein as second restricting portions.

The locks 28 are arranged to face the corresponding busbar pressers 21B, 23B. Thus, the locks 28 and the busbar pressers 21B, 23B are arranged in a concentrated manner. The bolt fastening portions 11 are arranged at the left and right sides of the busbar pressers 21B, 23B. Thus, the respective round terminals 50 can be arranged at the both left and right sides of the respective busbar pressers 21B, 23B. Therefore wires connected to the respective round terminals 50 can be drawn out so as not to cross.

Jig insertion openings 21C, 23C are formed at positions of the respective busbar pressers 21B, 23B corresponding to the respective locking holes 33, 41 for permitting insertion of a disengaging jig (not shown) for disengaging the locks 28 from the respective locking holes 33, 41. The jig insertion openings 21C, 23C also function as confirmation windows, through which the engaged states of the respective locks 28 and the respective locking holes 33, 41 are confirmed.

A state where both busbars 30, 40 are mounted in the corresponding busbar mounting portions 21, 23 is a partly locked state, and the busbars 30, 40 are fixed in a fully locked state in the corresponding busbar mounting portions 21, 23 by fastening the bolts B to the respective bolt fastening portions 11. Bolt fastening is carried out after the round terminals 50 are set on the terminal block 10. The bolts B and nuts N then are screwed together and the fastening parts 32, 42 of the busbars 30, 40 and the round terminals 50 are sandwiched between the bolts B and the nuts N.

The terminal block 10 is used by initially inserting the nuts N into the respective nut accommodating recesses 27 of the housing 20 in the first direction D1. The busbars 30, 40 are mounted into the corresponding busbar mounting portions 21, 23 in the second direction D2 after all of the nuts N are mounted. Thus, the busbars 30, 40 hold the nuts N in the respective nut accommodating recesses 27. Further, movements of the busbars 30, 40 in the direction opposite to the second direction D2 are restricted by the engagement of the respective locks 28 with the corresponding locking holes 33, 41. Further, movements of the both busbars 30, 40 in the direction substantially opposite to the first direction D1 are restricted by the respective busbar pressers 21B, 23B. In this way, the busbars 30, 40 are held in the corresponding busbar mounting portions 21, 23 and all the bolt fastening portions 11 are held in the partly locked state.

Subsequently, positive and negative round terminals 50 connected or to be connected to a battery (not shown) are connected, for example, to a pair of bolt fastening portions 11 arranged on a left lower side of FIG. 2. The round terminals 50 and the respective busbars 30, 40 are bolt-fastened by arranging the round terminals 50 on the bolt fastening portions 11 and fastening the bolts B. In this way, all of the bolt fastening portions 11 are held in the fully locked state. For example, in the case of connecting the positive side round terminal 50 to the bottommost right bolt fastening portion 11, positive side power is supplied to the bolt fastening portion 11 on the right lower side, the bolt fastening portion 11 on the right upper side and the bolt fastening portion 11 on the left upper side through the large busbar 30. On the other hand, the four bolt fastening portions 11 located in the center are connected to a negative side of the battery (or body earth) through the round terminal 50 connected to the second bolt fastening portion 11 from below on the left side.

The terminal block 10 may be mounted a refrigerator truck. Thus, a refrigerator, an inverter, a compressor and the like can be connected to this terminal block 10. In this case, the positive side round terminal 50 of the compressor may be connected to the bolt fastening portion 11 on the right lower side of FIG. 2, and the negative side round terminal 50 may be connected to the second bolt fastening portion 11 from below on the right side. Further, the positive side round terminal 50 of the refrigerator may be connected to the bolt fastening portion 11 on the right upper side and the negative side round terminal 50 may be connected to the second bolt fastening portion 11 from above on the right side. Similarly, the positive side round terminal 50 of the inverter may be connected to the bolt fastening portion 11 on the left upper side and the negative side round terminal 50 may be connected to the second bolt fastening portion 11 from above on the left side. In this way, power is distributed and supplied to the respective devices via the terminal block 10.

As described above, the first direction D1, which is the mounting direction of the nuts N, and the second direction D2, which is the mounting direction of the busbars 30, 40, intersect and are substantially normal to each other. The nuts N are held in the respective nut accommodating recesses 27 by the busbars 30, 40, and a nut retainer is not needed. Further, the busbar pressers 21B, 23B restrict movements of the busbars 30, 40 in the direction opposite to the first direction D1 and the locks 28 restrict movement of the busbars 30, 40 in the direction opposite to the second direction D2 to hold the busbars 30, 40 suitably in the corresponding busbar mounting portions 21, 23.

The right part 31 of the large busbar 30 is bent toward the rear of the housing 20 to avoid interference between the right part 31 of the large busbar 30 and the round terminals 50. Further, the busbar pressers 21B, 23B extend vertically to cross the respective busbars 30, 40 to simplify the structures of the respective busbar pressers 21B, 23B.

Further, the small busbar presser 21B bridges between the opposite partition walls 22 and the large busbar pressers 23B bridge between the two corresponding guide walls 24. Thus, the busbars 30, 40 are surrounded over substantially their entire peripheries and the rigidities of the respective busbar pressers 21B, 23B is increased. Furthermore, since the locks 28 and the respective busbar pressers 21B, 23B substantially face each other and hence are arranged in a concentrated manner. Thus, the bolt fastening portions 11 can be arranged at the opposite left and right sides of the respective busbar pressers 21B, 23B, and the respective wires connected to the respective round terminals 50 can be drawn out so as not to cross.

The invention is not limited to the above described and illustrated embodiment. For example, the following embodiments also are included in the scope of the invention.

Large and small busbars 30 and 40 having different sizes are provided in the above embodiment. However, the busbars 30, 40 may be substantially the same size.

Only the large busbar 30 is bent in the above embodiment. However, the small busbar 40 also may be bent or neither of the busbars 30, 40 may be bent.

The busbar pressers 21B, 23B extend substantially vertically in the above embodiment. However, they may extend substantially laterally and/or may press only one or more lateral edges of the fastening parts 32, 42 of the busbars 30, 40.

Although the busbar pressers 21B, 23B are formed to cover both busbars 30, 40 over the substantially the entire peripheries in the above embodiment, the both busbars 30, 40 may be pressed only at the opposite lateral edge portions.

The locking pieces 28 are provided at positions substantially facing the corresponding busbar pressers 21B, 23B in the above embodiment. However, the locking pieces need not face the corresponding busbar pressers 21B, 23B.

What is claimed is:

1. A terminal block, comprising:

a housing;

at least one nut accommodating recess formed in the housing for holding at least one nut to be mounted in a first direction and being configured for preventing the nut from turning;

at least one busbar mounting portion communicating with the nut accommodating recess and located at a side closer to an outer surface of the housing than the nut accommodating recess;

at least one busbar which can hold the nut in the nut accommodating recess by being at least partly mounted into the busbar mounting portion in a second direction intersecting with the first direction;

at least one first restricting portion provided at the busbar mounting portion for restricting a movement of the busbar in the busbar mounting portion in a direction substantially opposite to the first direction; and at least one second restricting portion provided at the busbar mounting portion for restricting a movement of the busbar in the busbar mounting portion in a direction substantially opposite to the second direction.

2. The terminal block of claim 1, wherein:

at least one terminal is to be bolt-fastened to the busbar, and the busbar is so bent as to circumvent the terminal and a wire connected to the terminal.

3. The terminal block of claim 1, wherein the first restricting portion extends in a direction intersecting both the first and second directions.

4. The terminal block of claim 3, wherein the housing includes side walls extending along lateral edges of the busbar and the first restricting portion extends between the side walls and covers at least part of the busbar.

5. The terminal block of claim 1, wherein the second restricting portion is opposed to the first restricting portion in the busbar mounting portion.

6. A terminal block, comprising:

a housing;

at least one busbar mounting surface on the housing;

at least one nut accommodating recess extending into the busbar mounting surface and configured for nonrotatably receiving a nut;

at least one busbar having a first surface mounted on the busbar mounting surface and extending at least partly across the nut accommodating recess, the busbar further having a second surface opposite the first surface;

at least one first restricting portion opposing the second surface of the busbar for restricting a movement of the busbar away from the busbar mounting surface; and at least one second restricting portion substantially adjacent the busbar mounting surface for restricting a movement of the busbar parallel to the busbar mounting surface.

7. The terminal block of claim 6, wherein the first restricting portion bridges the busbar mounting surface.

8. The terminal block of claim 7, wherein the second restricting portion comprises a resiliently deformable lock engaged with the busbar.

9. The terminal block of claim 8, wherein the second restricting portion comprises at least one wall engaging a peripheral edge of the busbar.

10. A method of assembling a terminal block, comprising:

providing a housing having at least one busbar mounting surface extending in a first direction and at least one nut accommodating recess extending into the busbar mounting surface along a second direction substantially orthogonal to the first direction;

mounting a nut in the nut accommodating recess along the first direction;

sliding a busbar along the busbar mounting surface in the second direction so that the busbar at least partly covers the nut in the nut accommodating recess;

engaging the busbar with at least one restricting portion on the housing for restricting movement of the busbar on the busbar mounting surface in a direction substantially opposite to the first direction; and engaging the busbar with at least one lock in or at the busbar mounting surface for restricting movement of the busbar along the busbar mounting surface in a direction substantially opposite to the second direction.

11. The method of claim 10, wherein the restricting portion bridges the busbar mounting surface and the step of sliding a busbar along the busbar mounting surface comprises sliding the busbar between the busbar mounting surface and the restricting portion.

12. The method of claim 11, wherein the step of sliding a busbar along the busbar mounting surface comprises sliding the busbar between a pair of side walls extending in the second direction for restricting movement of the busbar in directions normal to the first and second directions.

* * * * *